US005520022A

United States Patent [19]

Callaway

[11] Patent Number: 5,520,022

[45] Date of Patent: May 28, 1996

[54] TACK OR WIPING CLOTH

[75] Inventor: Brian Callaway, Moore, S.C.

[73] Assignee: Milliken Research Corporation, Spartanburg, S.C.

[21] Appl. No.: 127,047

[22] Filed: Sep. 27, 1993

[51] Int. Cl.[6] ..... D04B 7/12

[52] U.S. Cl. ..... 66/194; 66/191; 66/195

[58] Field of Search ..... 66/190, 191, 192, 66/194, 195, 196

[56] References Cited

U.S. PATENT DOCUMENTS

| | | | |
|---|---|---|---|
| 1,811,813 | 6/1931 | Wagner . | |
| 2,957,327 | 10/1960 | Glover | 66/191 |
| 2,968,085 | 1/1961 | Matthews | 66/190 X |
| 3,977,216 | 8/1976 | Lombardi et al. | 66/111 |
| 4,052,238 | 10/1977 | Botvin | 156/148 |
| 4,540,398 | 9/1985 | Barson et al. | 604/1 |
| 4,587,811 | 5/1986 | Hiromoto et al. | 66/196 |
| 4,811,573 | 3/1989 | Sternlieb | 66/193 |
| 4,888,229 | 12/1989 | Paley et al. | 428/192 |
| 5,058,399 | 10/1991 | Watisse et al. | 66/203 |

FOREIGN PATENT DOCUMENTS

| | | | |
|---|---|---|---|
| 2263575 | 7/1974 | Germany | 66/195 |
| 2614598 | 10/1977 | Germany | 66/194 |
| 0001753 | 1/1984 | Japan | 66/191 |
| 0099053 | 6/1985 | Japan | 66/195 |
| 2289657 | 12/1987 | Japan | 66/194 |

OTHER PUBLICATIONS

Analysis of Tricot Velour Fabrics, Darlington, Scottish School of Textiles, Kniting Times, Feb. 16, 1976, pp. 33–37.

*Primary Examiner*—John J. Calvert
*Attorney, Agent, or Firm*—Terry T. Moyer; Earle R. Marden

[57] ABSTRACT

A warp knit fabric having loops projecting outwardly therefrom on both the face and back of the fabric which can be used as a wiping cloth, female connector fabric, etc. The fabric is a three-bar fabric having bar movements of (1) 1-0, 0-1, 1-0, 0-1; (2) 6—6, 0-1, 4—4, 0-1; and (3) 4—4, 3—3, 4—4, 1—1.

13 Claims, 4 Drawing Sheets

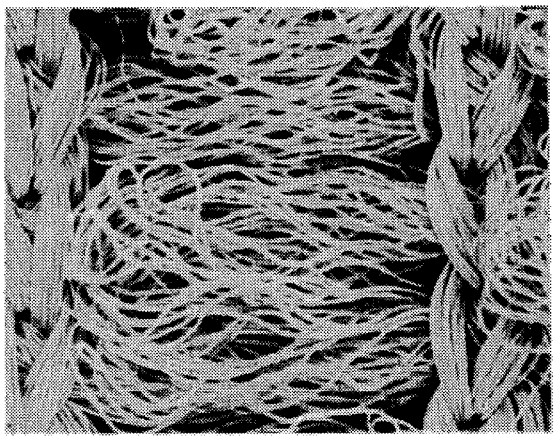
FIG. –3–
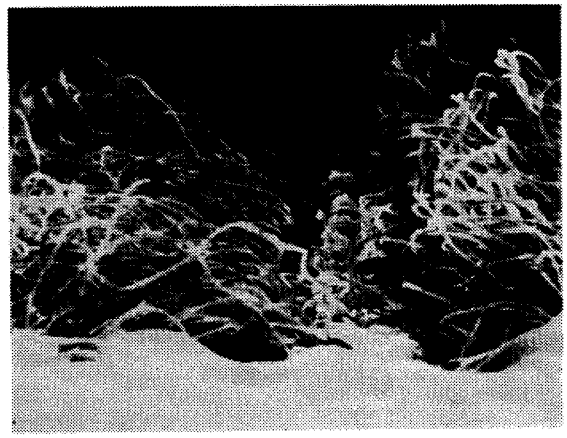
FIG. –4–
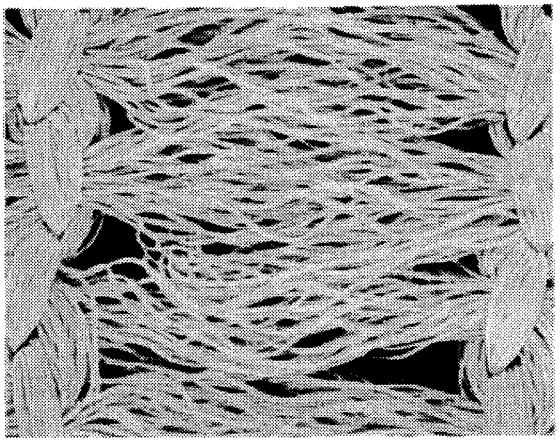
FIG. –5–
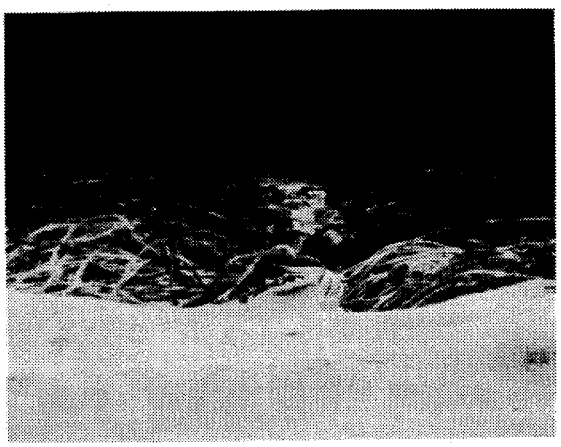
FIG. –6–

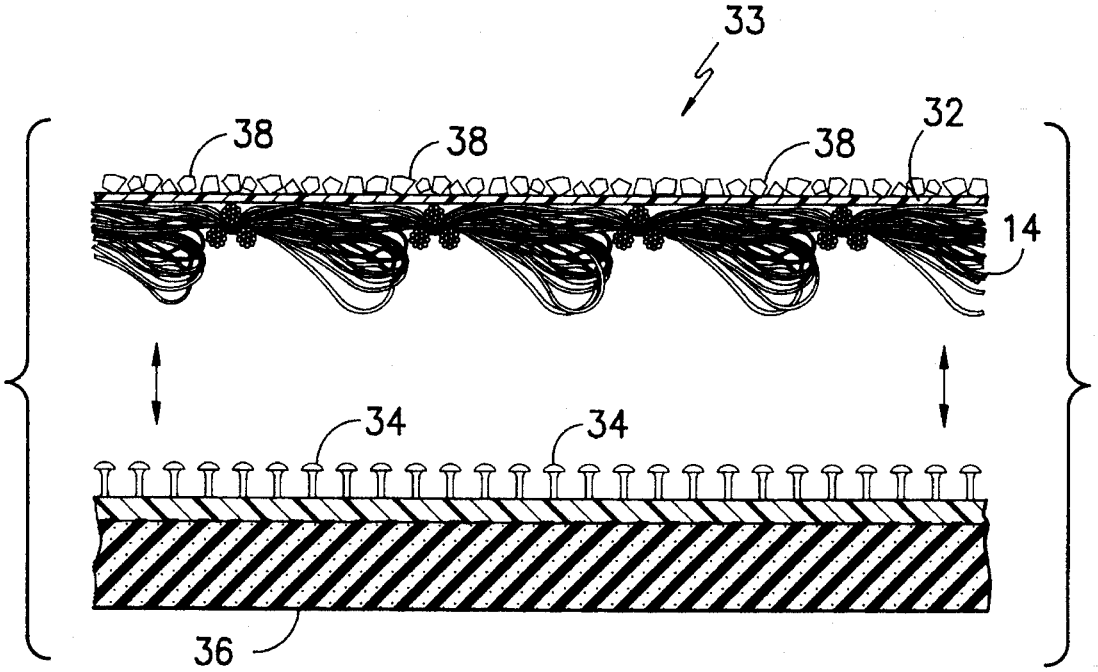
FIG. —11—

TACK OR WIPING CLOTH

This invention is directed to a knitted fabric which provides loops on both sides of the fabric so that it can be used as a wiping cloth or a female connector fabric without discerning which side of the fabric is up or down to perform the required function.

In the past knit fabrics having loops on one surface thereof have been employed as wiping cloths but the user thereof had to be alert so that the looped surface of the fabric was placed in the area to be cleaned. This required the operator to spend time inspecting the particular wiping cloth to be sure that the proper surface was being used or otherwise an improper cleaning function was performed on the surface of the object being wiped.

Therefore, it is an object of the invention to provide a knitted fabric which has looped surfaces on both sides thereof so that when the fabric is made into a wiping cloth an operator is able to pick up the fabric and use it without worrying which surface is in contact with the surface being cleaned.

Another object of the invention is to provide a looped fabric which can be employed as the female connection of a hook and loop connector.

Other objects of the invention will become clearly apparent as the specification proceeds to describe the invention with reference to the accompanying drawings, in which:

FIGS. 3 and 5 are enlarged scanning electron microscopic top and bottom views, respectively, of a section of the fabric shown in FIG. 1;

FIGS. 4 and 6, respectively, are tilted enlarged scanning electron microscopic view of the sections of the fabric shown in FIGS. 3 and 5 showing the loops projecting from the upper and lower surfaces of the knit fabric.

Figure 1:
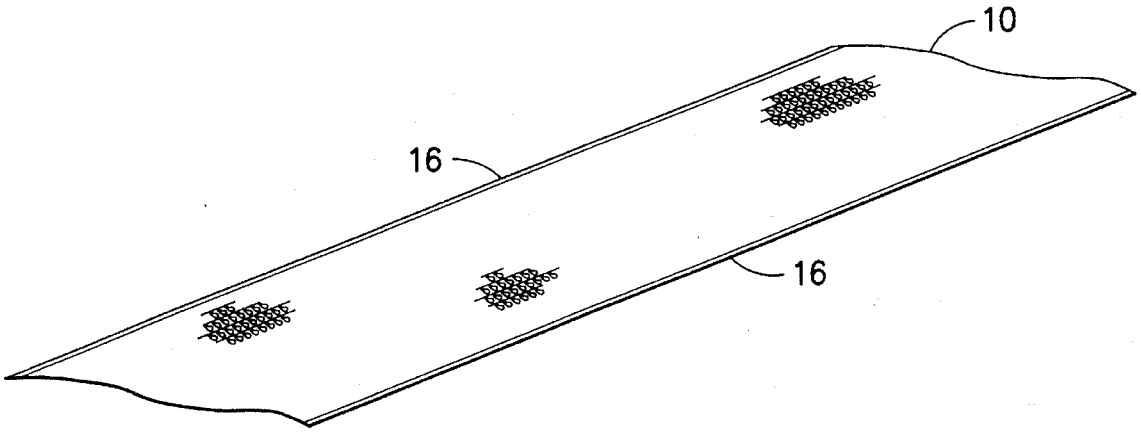
FIG. 1 shows a running length of the new and improved knit fabric.
Figure 7:
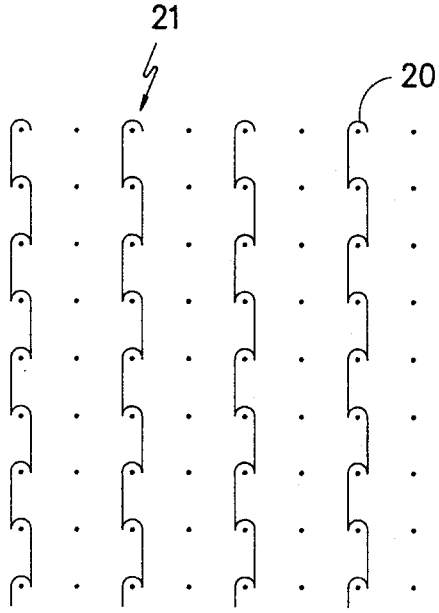
Figure 8:
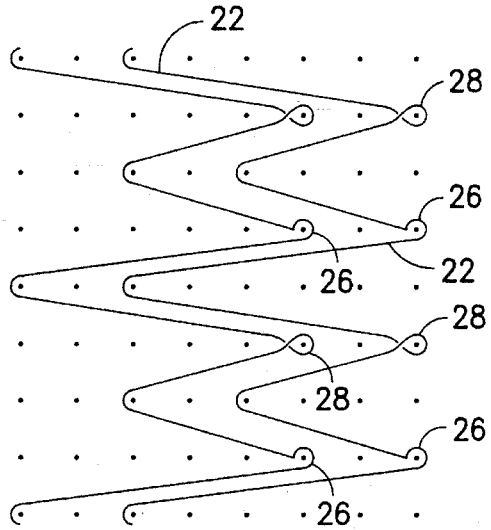
Figure 9:
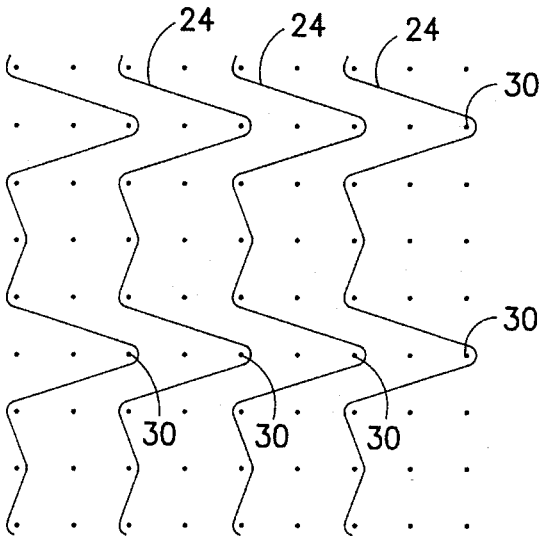
Figure 10:
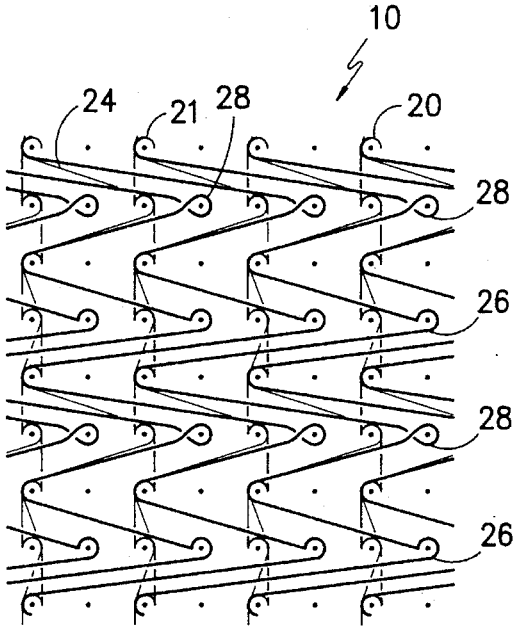

FIGS. 7–9 are diagrams of the knitting machine bar movements to knit the subject fabric;

FIG. 10 is a diagram of combined bar movements to knit the fabric of FIG. 1; and FIG. 11 is a schematic cross-section view of the fabric being used as a female connector element.

Figure 2:
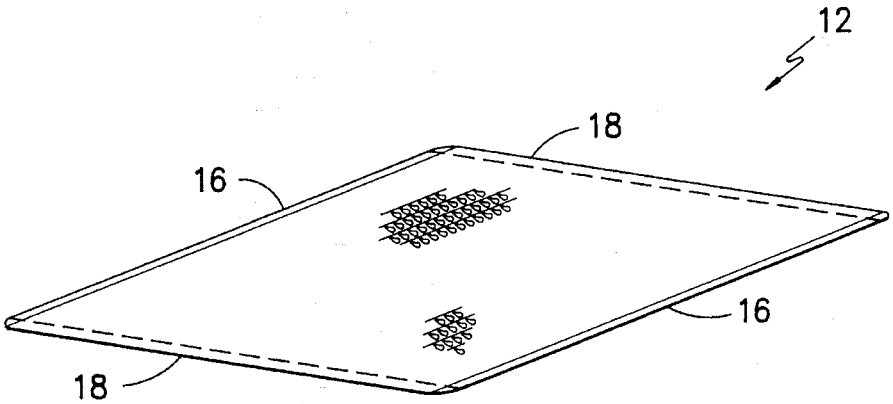
FIG. 2 is a view of a wiping cloth cut and sealed from the fabric of FIG. 1.

Looking now to the drawings, the reference number 10 represents the new and novel knit fabric shown in FIG. 1 from which the wiping cloth 12 of FIG. 2 and the female connector 14 of FIG. 11 are cut from the fabric 10. When the fabric 10 is being used to produce the wiping cloth 12 a selvedge 16 is knit during the knitting of the fabric 10 so that when the fabric 10 is slit transversely with a hot knife cutter or a laser cutter the completed wiping cloth 12 is produced since the fabric contains synthetic yarns which are melted or softened when cut and fuse upon cooling after cutting to form the selvedge 18. If the fabric 10 is used for other purposes, such as a female connector, the formation of the selvedge is not absolutely necessary. When the fabric 10 is rolled up and used as a roll towel in a roll towel drying machine the selvedge is necessary to prevent the towel from unravelling or being distorted.

The fabric 10 is, preferably, a Raschel knit 3 bar fabric as shown schematically in FIGS. 7–10 but could be made on a tricot knitting machine, if desired, In the preferred form of the invention all of the yarns employed are 1/150/34 polyester yarns with the yarn in bar i being drawn only while the yarns in bars 2 and 3 are textured. It is obvious that other yarns such as nylon could be used, if desired.

As shown in FIG. 7 bar 1 is knitting yarn 20 in a chain stitch 21 with a bar movement of 1-0, 0-1, 1-0, 0-1 while the loop forming yarn 22 on bar 2 is knitted with a bar movement of 6—6, 0-1, 4—4, 0-1. The lay in yarn 24 is knitting with a bar movement of 4—4, 3—3, 4—4, 1—1 to provide stability in the widthwise direction and to prevent every other loop in the wale direction of the fabric from going to the back of the fabric.

Looking at FIGS. 3–6 it can be seen that loops of yarn between the adjacent wales of chain stitches 21 project outwardly from the face and the back of the fabric as shown, respectively, in FIGS. 4 and 6. It should be noted that the loops on the face of the fabric are more prominent than on the back which is important for some intended uses of the fabric.

Looking at FIGS. 8 and 10 it can be seen that the yarn 22 in the wale direction of the fabric alternates between an open stitch 26 and a closed stitch 28 located from one another two courses apart in the wale direction with adjacent open or closed stitches in each course being spaced two wales apart. The open stitches 26 provide the loops on the back side of the fabric while the closed stitches 28 provide the loops on the face of the fabric. As mentioned before the lay in yarn on bar 3 provides stability to the fabric in the transversal direction, while the chain stitch yarn 20 provides stability in the longitudinal direction, and loops around the same needle 30 in the same course as the open stitches 26 on every fourth course of the fabric 10 to prevent the open stitches 28 from projecting into and outward from the back of the fabric.

It can be seen that the above-described fabric when formed into a wiping cloth 12 as shown in FIG. 2 provides a wiping cloth which has loops on both the face and back side. This allows a user to arbitrarily pick up a cloth 12 without concern as to which side is up and use it indiscriminately to wipe the desired surface such as the finish on an automobile.

As mentioned briefly before the herein-described fabric 10 can be used as the female connector 14 for a hook and loop Velcro-type connector. This type of connector involves a male member with hooks or projections thereon which interengage a female member with loops or strands projecting upwardly therefrom which are engaged by the hooks or projections to maintain two elements in engagement with one another.

A typical application of the new and improved fabric 10 would be as a female connector fabric for an abrasive fabric 32 as shown in FIG. 11. The fabric 10 would be cut to desired size and adhered to the abrasive fabric 32 to form the sheet 33 with the loops on the face thereof being exposed and facing the hooks or projections 34 mounted on the rotatable mandrel 36. The sheet 33 is placed against the mandrel 36 and the hooks 36 engage the loops to hold the sheet 33 on the face of the mandrel 36 so that the abrasive particles 38 on the abrasive fabric 32 can be placed against an area to be abraded or sanded. Obviously, this is only one application of the fabric since it can be used anywhere it is desired to securely mate together two members using a hook and loop connection.

It can readily be seen that the herein-described fabric is simple in construction, relatively inexpensive to manufacture and provides many useful and simple functions.

It is contemplated that changes and modifications may be made within the scope or spirit of the invention and it is therefore requested that the disclosed invention be limited only by the scope of the claims.

I claim:

1. A wiping cloth having loops on both sides thereof comprising: warp knit fabric having a plurality of wales and courses, a plurality of chain stitches spaced from one another in the wale direction of the fabric, a plurality of courses of open stitches, a plurality of courses of closed stitches between adjacent courses of open stitches forming loops on the face side of the fabric, a plurality of lay-in yarns under tension engaging and forcing the open stitches outwardly from the back side of said wiping cloth.

2. The wiping cloth of claim 1 wherein said lay-in yarn engages said open stitch in every fourth course of said warp knit fabric.

3. The wiping cloth of claim 2 wherein the design of the warp knit fabric is represented-with a chain stitch bar movement of 1-0, 0-1, 1-0, 0-1, the open and closed stitches by a bar movement of 6—6, 0-1, 4—4, 0-1 and the lay-in yarn by a bar movement of 4—4, 3—3, 4—4, 1—1.

4. The wiping cloth of claim 3 wherein said warp knit fabric is a three-bar fabric.

5. The wiping cloth of claim 4 wherein the warp knit fabric has at least two selvedges knit integral therewidth.

6. A warp knit fabric comprising: a plurality of wales of chain stitches, a plurality of courses of open stitches, a plurality of courses of closed stitches between said courses of open stitches forming loops on the face side of the fabric and a lay-in yarn under tension in a plurality of wales engaging said open stitches in a plurality of courses causing said open stitches to form loops on the back side of said fabric.

7. The fabric of claim 6 wherein said open and closed stitches alternate between courses.

8. The fabric of claim 7 wherein said open and closed stitches are spaced two wales from one another.

9. The warp knit fabric of claim 8 wherein the design of the warp knit fabric is represented with a chain stitch bar movement of 1-0, 0-1, 1-0, 0-1, the open and closed stitches by a bar movement of 6—6, 0-1, 4—4, 0-1 and the lay-in yarn by a bar movement of 4—4, 3—3, 4—4, 1—1.

10. The method of warp knitting a fabric with loops in the face and back side thereof comprising the steps of: forming a plurality of wales of chain stitches on one bar, forming a plurality of alternating open and closed stitches on a second bar in the same wales as said chain stitches and laying in a third yarn under tension by movement of a third bar so as to engage the open stitches and force them outwardly from the back of the fabric formed.

11. The method of claim 10 wherein the open stitches are spaced two wales from the closed stitches.

12. The method of claim 11 wherein the lay-in yarn engages every other open stitch in each of said wales.

13. The method of claim 11 wherein the design of the warp knit fabric is made with a chain stitch bar movement of 1-0, 0-1, 1-0, 0-1, the open and closed stitches by a bar movement of 6—6, 0-1, 4—4, 0-1 and the lay-in yarn by a bar movement of 4—4, 3—3, 4—4, 1—1.

* * * * *